United States Patent [19]

Taub

[11] 3,963,126

[45] June 15, 1976

[54] REVOLUBLE TIERED BIN STAND

[75] Inventor: Ronald H. Taub, Highland Park, Ill.

[73] Assignee: Taub Family Trust U/A, Chicago, Ill.

[22] Filed: Nov. 4, 1974

[21] Appl. No.: 520,629

[52] U.S. Cl. ..... 211/131; 40/145 R; 211/181

[51] Int. Cl.[2] ..... A47F 3/14

[58] Field of Search ..... 211/129, 131, 181, 133, 211/144, 88, 126, 177, 181; 248/221, 225, 243; 18/94, 95; 40/145, 124.1

[56] References Cited

UNITED STATES PATENTS

| | | | |
|---|---|---|---|
| 1,292,137 | 1/1919 | Strout | 40/145 R |
| 3,051,319 | 8/1962 | Glaser | 211/133 |
| 3,221,429 | 12/1965 | Reuben et al. | 40/124 X |
| 3,266,634 | 8/1966 | Tintary | 211/131 |
| 3,404,783 | 10/1968 | Whitman et al. | 211/88 |
| 3,452,880 | 7/1969 | Kovacik et al. | 211/131 X |
| 3,538,863 | 11/1970 | Howard et al. | 211/129 X |
| 3,595,404 | 7/1971 | Goldstein | 211/133 X |
| 3,739,919 | 6/1973 | Hochman | 211/177 |
| 3,833,128 | 9/1974 | Sumner | 211/181 X |

FOREIGN PATENTS OR APPLICATIONS

| | | | |
|---|---|---|---|
| 710,030 | 6/1954 | United Kingdom | 248/225 |

*Primary Examiner*—Roy D. Frazier
*Assistant Examiner*—Robert W. Gibson, Jr.
*Attorney, Agent, or Firm*—Glenn E. Klepac

[57] ABSTRACT

A rack or stand including a rotatable vertical central shaft and a tiered array of wire bin assemblies carried thereby. Each bin assembly consists of an annularly disposed series of separate trays circumferentially arranged about the shaft and each individually fastened to the shaft of the rack by means of post-like probes integral with each tray and extending into cooperating vertically spaced radial apertures formed in the shaft to secure and lock the trays of each tier laterally to one another to stabilize and brace the bin assemblies.

6 Claims, 8 Drawing Figures

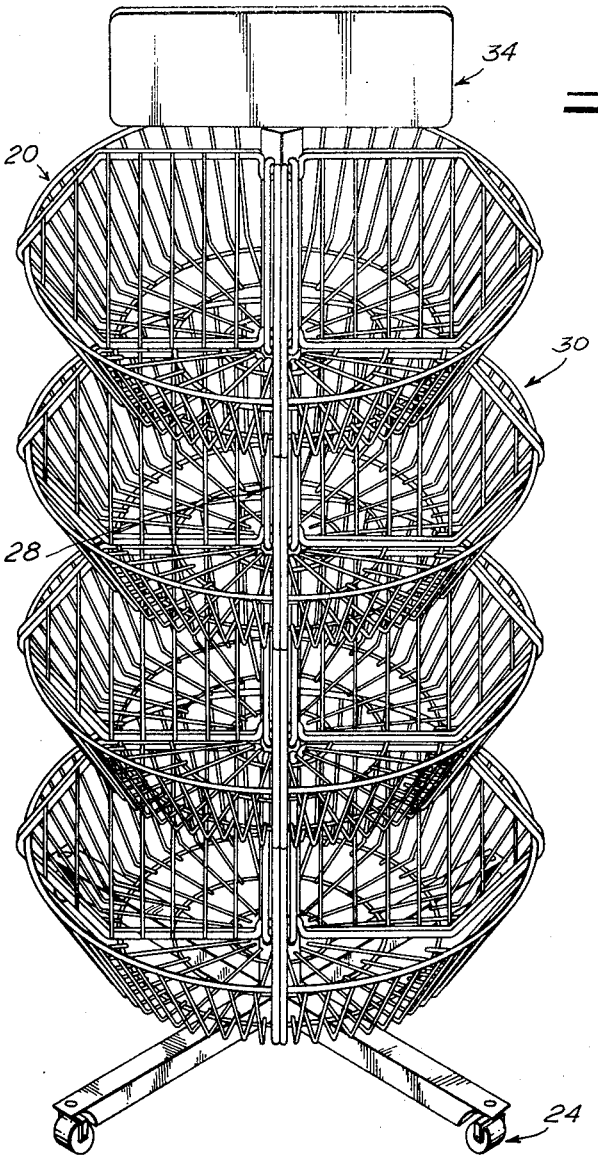
Fig. 1
Fig. 4
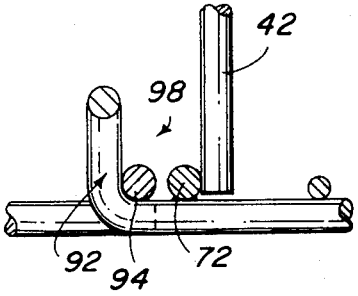
Fig. 7
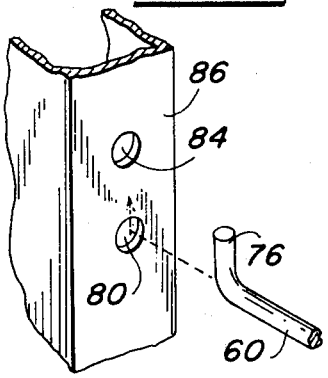
Fig. 2
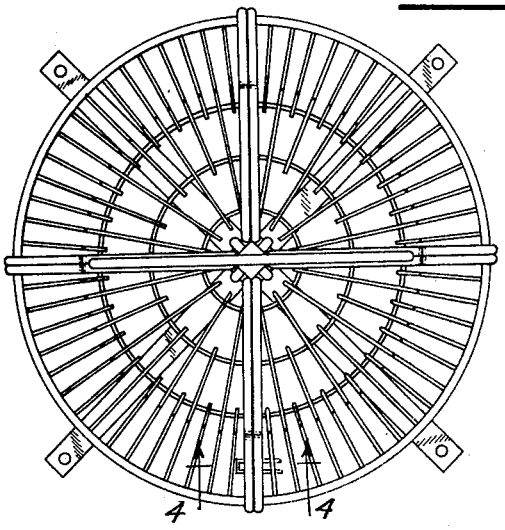
Fig. 3
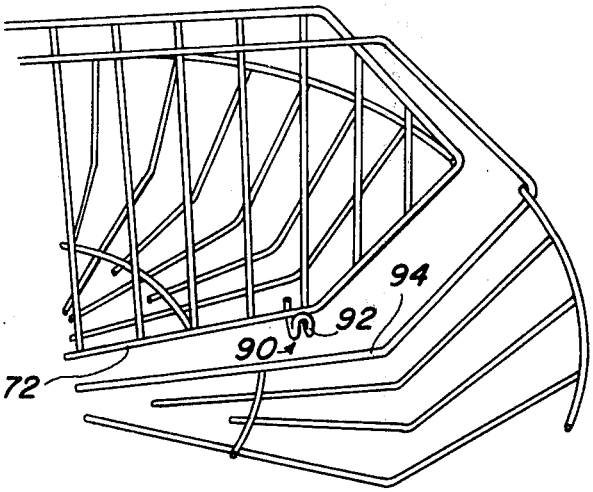

102
100
106
126
124
134
116
130
110
120
112
80
84
108
110
162
160
176
164
154
178
174
40
54
76
8
170
60
90
62
72
180
44
68
140
144
156
150
24

REVOLUBLE TIERED BIN STAND

BACKGROUND OF THE INVENTION

This invention relates to a rotatable display assembly. More particularly, the invention is directed to a tiered rack or stand which includes a series of vertically spaced basket-like bins secured to and revoluble with a vertical shaft or central standard rotatably mounted on a base or pedestal.

Many types of display stands including revolving stands are known in the prior art. These stands have, for the most part, been designed for specific limited or special purposes such as the storage and display of special items. Other stands have been intended for more general use. The stand of the present invention falls in the latter catagory.

In the field of revolving tiered bins and similar structures, the art is repleat with useful structures. For the most part, however, such structures have been unduly complex and, accordingly, both difficult and costly to produce. While prior art structures include bearing means to facilitate the rotation of the rack and while prior art structures also include means for securing each of the tiered containers to a supporting shaft, the particular means used in effectuating these common functions have varied considerably from product to product. Additionally, the precise configuration and structrual arrangement of the bins themselves are exceedingly diverse. It has been a common practice in the prior art to provide annular bins which are uniitary and which, therefore, are exceedingly bulky rendering shipment of the display rack to the point of use inconvenient. It is, therefore, the aim of the present invention to obviate the above-indicated and other shortcomings of the prior art rotatable rack assemblies and to provide an improved structure finding broad utility and having in-use and shipping advantages not heretofore realized.

It is a principal feature of the invention that there is provided, in a rotatable display rack, bin assemblies which consist of a plurality of sector-like trays disposed to abut one another laterally and circumferentially arranged about so as completely to encircle the center shaft of the rack.

Another important feature of the improved rotatable display rack of the invention is that each of several trays of a tier is separately and individually supported on the shaft.

A related feature of the invention is that, in a preferred embodiment, each of the tray units is identical and, accordingly, machining, manufacturing costs, and assembly costs are minimized.

Still another feature of the invention is that, while each of the bin assemblies which encircles the rotatable shaft constitutes a series of trays, the tray units themselves are mechanically interlocked laterally to form a stable and secure structure.

Yet another feature of the invention also contributing to the ease and convenience of shipping the rack in a knocked down form, is that the central shaft itself comprises two or more separate disconnectable lineal units.

A material and weight-conserving feature of the invention is that the individual tray units of the bin assemblies are formed with one open side, that side abuting a facing closed side of a next adjacent tray unit.

In a preferred embodiment of the rotatable display rack of the invention, there is provided an improved header card attachment and securement mechanism.

Still another practical feature of the display rack of the invention is that the individual tray elements of the bin assemblies are conveniently nestable to conserve shipping space.

Another feature of the invention is that the various components of the rack are structurally exceedingly strong and durable and are easily maintained to present a clean and esthetically attractive appearance.

SUMMARY OF THE INVENTION

The display stand of the invention comprises a tiered array of rotatably supported basket-like bins, each tier consisting of a plurality of tray elements, each tray being individually fastened to the supporting shaft, and each mechanically coupled to the tray adjacent to provide a unitary, stable, and firmly braced tier assembly. The rotatable shaft is surmounted, in a preferred embodiment of the invention, by a card or placard which is itself secured to the shaft so as to preclude casual removal therefrom. The open-top tray units of the bin assemblies are characterized in that they are sector-like in contour and include a floor, a front wall, but only one side wall.

Other and further features and advantages of the invention will be evident upon reading the detailed description which follows considered in conjunction with the drawing.

BRIEF DESCRIPTION OF THE DRAWINGS:

FIG. 1 is a front perspective view of the rotatable tiered bin stand in accordance with the invention;

FIG. 2 is a top plan view of the stand;

FIG. 3 is an enlarged fragmentary view showing portions of two adjacent bin trays of the invention prior to their being interlocked to one another laterally;

FIG. 4 is an enlarged fragmentary cross sectional veiw taken on the lines 4—4 of FIG. 2 and indicating schematically the manner in which two adjacent tray units are intercoupled mechanically;

FIG. 7 is a fragmentary view indicating schematically the manner in which the upper probe or post of a tray element is lockingly inserted into a cooperating radial aperture formed in the tray-supporting shaft, the structure indicated in FIG. 7 being an enlargement of the encircled portion of FIG. 6.

DESCRIPTION OF THE PREFERRED EMBODIMENT

Figures 5, 6, 8:
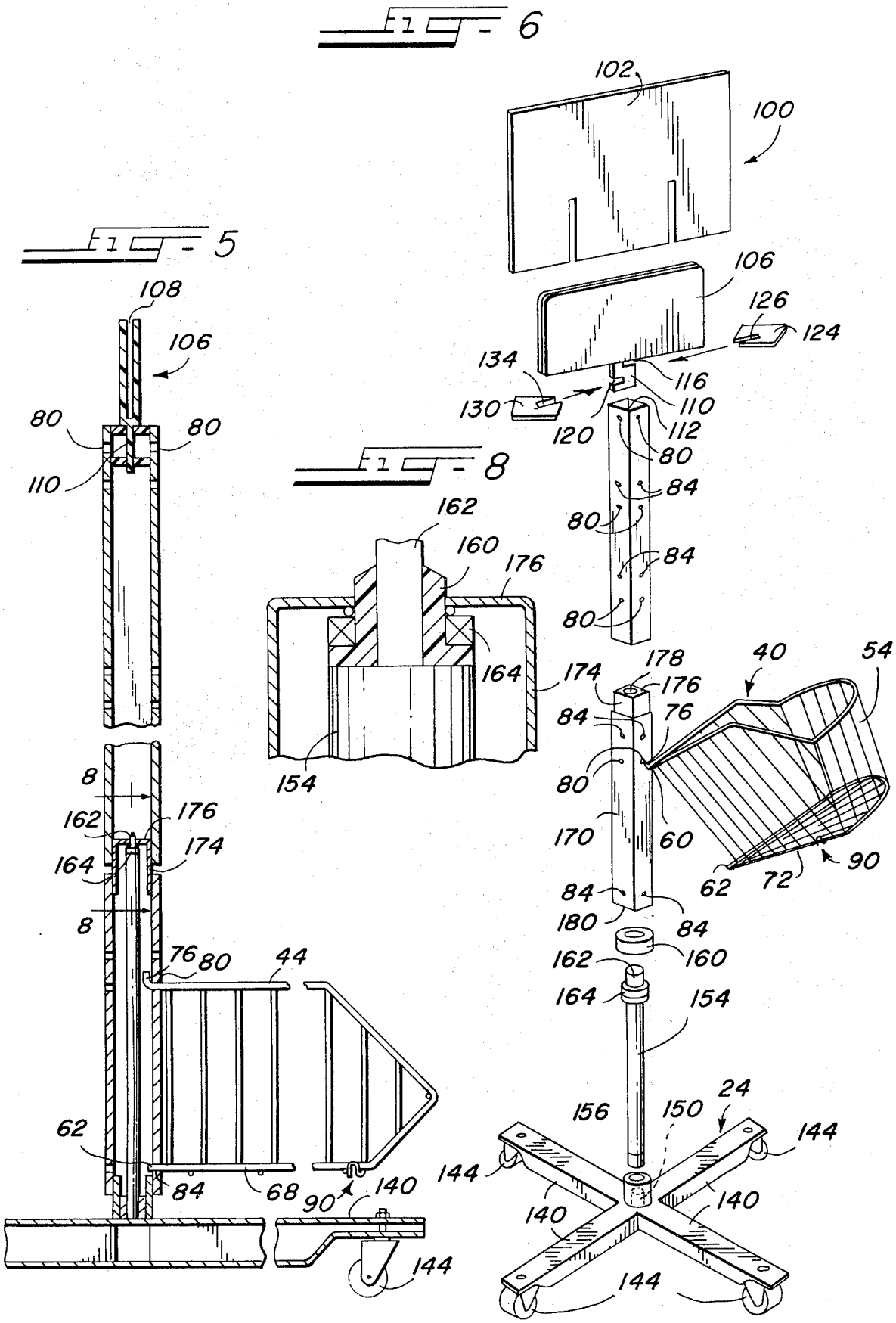
FIG. 5 is a vertical cross sectional view showing how the rotatable shaft of the rack of the invention is carried on the pedestal and indicating also the manner in which a tray unit is secured to and supported on the central shaft of the bin rack.
FIG. 6 is an exploded view showing the base or pedestal of the rack, the various components of the multisectional shaft, the arrangement of bearings to facilitate the rotatability of the shaft, and the header card which surmounts and is supported on the shaft.
FIG. 8 is a cross sectional view taken substantially on the lines 8-8 of FIG. 5 showing the bearing structure which supports the rotatable shaft.

For purposes of illustrative disclosure and not to be considered as limiting the invention in any way, in accordance with a preferred embodiment of the invention, the aims and objects are accomplished by providing a revoluble tiered bin stand or rack, as illustrated, generally, in FIG. 1. As shown, the rack includes a base or pedestal 24, a vertical shaft 28 rotatably supported on the pedestal 24, a series of vertically spaced, basket-like bins 30 disposed as a tiered array on the shaft 28, and a header card 34 mounted on the shaft 28 at the top thereof. The circular bin 30 of each tier consists of a plurality of sector-like trays 40, the trays being disposed to abut one another laterally along radially extending side margins or side walls 42 and 44 so that, being circumferentially arranged about the supporting shaft 28, the trays 40 completely encircle the shaft. Each tier of the preferred embodiment of the invention is essentially the same and, as the tray units 40 themselves are identical with one another, only one will be described.

Each tray 40 is preferably of welded wire or welded rod construction and, as shown in FIGS. 1 and 6, each is sector-like in form. Structurally each tray 40 includes a floor 50, a side wall 42 extending upwardly from the floor 50 and normally thereof, and a front wall 54 arcuate in contour and connected to and interconnecting the floor 50 and the side wall 42 and flaring upwardly and outwardly from the floor 50.

It will be appreciated upon consideration of the tray 40 shown in FIG. 6 that the side "wall" 44 opposed to the side wall 42 is open, there being only a perimetric wire frame. In a preferred embodiment of the invention the second side wall lattice has been eliminated since its function is fulfilled by the side wall 42 of the tray 40 laterally adjacent the first tray. The novel structure described is important in substantially reducing the overall weight and cost of each tray unit without sacrificing any utilitarian advantage.

Referring further to the tray 40, and as shown in FIGS. 5 and 6, each tray includes a pair of vertically spaced probes 60 and 62 which, the the preferred embodiment of the invention illustrated, are integral extensions at the upper and lower ends of the tray spine or bar 66 which extends vertically between and interconnects the upper framing rod 68 and the lower framing rod 72 of the tray 40. The upper probe or projection 60 terminates in a stub section 76 which generally parallels but is set inwardly of the spine 66, whereas the lower projection 62 extends inwardly and transversely of the spine 66 so that the two probe elements 76 and 62 are mutually perpendicular, the former paralleling the shaft 28 and the latter being normal thereto.

The manner in which each tray element 40 is coupled into and supported on the shaft 28 will be described with reference to FIGS. 5, 6 and 7. The shaft 28, which is preferrably and conveniently of a hollow core construction, is provided, at vertically spaced positions, with an in-line series of pairs of radial apertures 80 and 84 whose lineal spacing corresponds to the vertical spacing between the probe elements 60 and 62 of the tray 40. Accordingly, in interconnecting the tray 40 to the shaft 28 it is necessary merely to pivot the tray counterclockwise, as indicated in FIG. 6 so as to facilitate the insertion of the end 76 of the upper probe into the aperture 80 in the wall 86 of the shaft 28 so that the end portion 76 of the probe 60 clears the wall 86 on the inside thereof, as indicated schematically in FIG. 7. With the upper probe 60 engaged and coupled into the shaft 28, the tray is pivoted to a horizontal position and the lower probe element 62 is inserted into the lower aperture 84 in the wall 86 of the shaft 28, as indicated schematically in FIG. 5.

In the preferred embodiment of the invention illustrated, the shaft 28 is rectangular in cross section and apertures for the mounting of tray elements are provided in each wall 86 of the shaft 28 so that a bin assembly 30 of a given tier consists of four sector-like trays 40 each constituting a quadrant, the trays being arranged perimetrically about the shaft 28 to complete a full circuit establishing a "continuous" basket about the shaft 28. Four tiers are shown in the embodiment of the invention illustrated in FIG. 1.

The lateral juxtaposition of adjacent tray elements 40 in each given tier serves to impart a high degree of stability to the bin assembly 30. In a preferred embodiment of the invention, however, auxiliary stabilizing means are utilized. As shown in FIGS. 3 and 4, the supplementary tray stabilizers and interlocks consist of mechanical intercoupling devices 90 which serves to interconnect the lower framing bar 72 of one tray with the essentially contiguous and abuting coextensive lower framing bar 94 of the tray element 40 laterally thereadjacent.

As seen most clearly in FIG. 3, the tray interconnector 90 comprises a loop 92 extending laterally outwardly from a lower framing element 72 of the tray 40 and bent upwardly to form an L-shaped flange 94 to define an upwardly opening slot 98 adjacent the side wall 42 of the tray element 40. The lateral spacing between the flange 94 and the tray wall 42 is such as to permit the insertion therewithin of the lower framing member 94 of the tray 40 thereadjacent and to preclude substantially lateral shifting within the slot, thereby to effect a positive and firm intercoupling engagement between adjacent tray elements.

In the specific embodiment of the invention illustrated, there is provided a header card or placard assembly 100 including as a major component a panel 102 on which advertising or promotional material may be imprinted or drawn. The panel 102 is frictionally received and retained in an upwardly and laterally opening sandwich clamp 106 defining a slot 108 into which the panel 102 is accepted. The clamp 106 is, in turn, secured to the shaft 28 at the upper extremity thereof, the mode of attachment being described below. The header card holder or clamp 106 is provided with a downwardly directed web 110 whose lateral dimension is such as to provide a sliding fit of the web 110 into the open end 112 of the tubular shaft 28. The web 110 is itself provided with an upper slot 116 and a lower slot 120 each extending inwardly from an outer side edge of the web 110, as indicated in FIG. 6. A washer 124, also provided with a slot 126 is slidably laterally inwardly into to intercouple with the web 110 at the slot 116 thereby to lock the washer 124 to the web 110 at a position of the web just beneath the clamp 106. The horizontal dimensions of the washer 124 are such as to preclude the entry of the washer downwardly into the open end 112 of the hollow shaft 28. A second washer 130 provided with a slot 134 is slidably engaged with the web 110 at the lower slot 120 to interlock the washer 130 with the web 110. The washer 130 is so dimensioned as slidably to enter into the open end 112 of the shaft 28 whereby the washer 130 assumes a position in the shaft 28 below the radial opening 80 into which the probe element 60 of the upper tier of bins is interengaged. Accordingly, with the web 110 positioned in place prior to attachment of the upper bin assembly 30 the insertion of the probe 60 of the tray 40 into the radial opening 80 positions the probe above the washer 130 and serves to lock the washer in place to preclude upward withdrawal of the web 110 and the web-supported panel 102 from the shaft 28.

Referring briefly to the construction of the pedestal 24 and the shaft 28 of the display, as best seen in the exploded view of FIG. 6, the pedestal 24 consists of intersecting and interconnected hollow channels 140 each provided with end connected support casters 144. A hollow cylindrical stub pipe or boss 150 is welded to and extends upwardly of the pedestal 24 at the cross-over of the pedestal arms 140. Secured in the boss 150 and extending upwardly thereof and normally of the pedestal 24 is a pipe 154. A bushing 156 of Nylon, Teflon or other low-friction material is sleeved over the boss 150, and a second bushing 160 is sleeved over a pipe extension 162 connected to the pipe 154 at the upper end thereof. An annular bearing 164 encircles and is secured to the extension 162, as shown in FIG. 8.

A lower shaft section 170 of hollow core construction and rectangular in transverse cross-section is provided at its upper end with a U-shaped projection 174 having formed therein at an upper bridging wall 176 thereof an opening 178 sized so as closely to engage and circumscribe the bushing 160 carried by the pipe extension 162 and to bear downwardly upon the bearing 164. At the same time, the lower open end 180 of the shaft section 170 circumscribes and annularly abuts the sleeve bushing 156 whereby a low friction engagement is established between the shaft section 170 and the pedestalmounted pipe 154, and the shaft section is readily rotatable.

The U-shaped projection 174 extending upwardly from the lower shaft section 170 is sized so as frictionally slidably to enter into and interlock with an upper shaft section 190 when the latter is forced downwardly over the extension 174 to abut the upper edge 192 of the lower shaft section 170, all as shown schematically in the cross sectional view of FIG. 5, thereby to provide a mechanically secure and stable bin-supporting shaft assembly which is freely rotatable on the pedestal 24.

While the above description is directed to a specific preferred embodiment, it is evident that modifications may be made constituting obvious variations of the subject invention. For example, whereas in the specific form of the invention illustrated and described, the shaft is square in cross section with tray units attached to each of the four walls, each attached tray fitting a quadrant, it is contemplated that a shaft triangular in section and having three circumscribing tray sections may be used. Additionally, while the tray units themselves have been shown as of welded steel rods, other structural materials such as plastics may be used and other modes of construction such as molding and casting may be employed.

Recognizing that a preferred method of assembly and installation of the various components elements of the assembly has been provided, it will be apparent that numerous modifications and variations thereof may be made without departing from the underlying principles of the invention. It is, therefore, desired by the following claims to include within the scope of the invention all such variations and modifications by which substantially the results of this invention may be obtained through the use of substantially the same or equivalent means.

What is claimed is:

1. In a display stand including a support pedestal, vertical shaft means rotatably supported on said pedestal, a series of vertically-spaced basket-like bin means, each said bin means consisting essentially of a plurality of sector-like trays disposed to abut one another laterally along radially extending side margins thereof, said trays being circumferentially arranged so as completely to encircle said shaft means, securement means detachably fastening said bin means as a tier in a tiered array on said shaft means for rotation therewith, said securement means comprising a pair of vertically spaced probes constituting rod-like projections unitary with each tray at radially inward extremities of each tray, said projections on each tray being disposed normally to one another with a first projection extending substantially parallel to said shaft means and a second projection extending substantially perpendicular thereto, each projection being adapted to penetrate into and to seat within a corresponding aperture formed in said shaft means, thereby to secure each tray detachably thereon, tray intercoupling means mechanically interlocking adjacent trays of each tier to one another at side margins thereof to stabilize and brace each tier of the tiered array, said intercoupling means consisting essentially of an L-shaped flange including a horizontally projecting rod-like support and an integrally formed upwardly directed area, means fastening said flange to extend laterally outwardly from a lower framing element of each one of said trays, said flange defining an upwardly opening slot receiving therewithin a lower framing element of an adjacent tray, whereby said flange serves both as an auxiliary support for an adjacent tray and as interlock means for contiguous trays of each tier;

the improvement wherein said display stand further comprises a header card and connector means for mounting said header card on said shaft means to extend upwardly therefrom, said connector means comprising a web joined to and depending downwardly from said header card, said web being dimensioned laterally to provide a sliding fit of said web downwardly into an axial opening formed at the top of said shaft means, said web having a radially directed slot extending inwardly from an outer edge of said web, and a web-coupling washer dimensioned to be received within said shaft means and to extend transversely thereof therewithin, said washer being formed with a radially inwardly directed slot adapted matingly to receive said web of said header card therewithin as said washer is simultaneously received within said web upon intercoupling of said web with said washer at respective slots formed therein, thereby to stabilize said header card against axial tilt upon insertion of said web with the intercoupled said washer into said shaft means.

2. The improvement as set forth in claim 1 and further comprising header card locking means to preclude casual removal of said header card from said display stand, said locking means comprising pin means extending into said shaft means through radial port means formed therein in a zone adjacent and above said web-coupling washer to overlie said washer and to prevent upward withdrawal thereof from said shaft means.

3. The improvement as set forth in claim 1 wherein said pin means consists of one of said probes of a tray and wherein said port means consist of a said radial aperture formed in said shaft means.

4. The improvement as set forth in claim 1 wherein said shaft means comprises a plurality of separate lineal sections and means detachably intercoupling said sections axially to one another.

5. The improvement as set forth in claim 1 wherein each tray of a tier includes one closed and one open side wall, and wherein, upon assembly of said tier the closed side wall of one tray is presented to the open side wall of a tray thereadjacent, whereby a single wall constitutes a separator for two adjacent trays of said tier.

6. The improvement as set forth in claim 1 wherein each tray includes a floor, a side wall extending from said floor and normally thereof, and a front wall connected to and interconnecting said floor and said side wall and extending upwardly and outwardly from said floor, whereby said trays may be stacked as an internesting assembly to facilitate shipment of said display.

* * * * *